United States Patent [19]

von der Eltz et al.

[11] Patent Number: 4,746,324

[45] Date of Patent: May 24, 1988

[54] ISOTHERMAL RAPID-DYEING PROCESS FOR WOOL WITH VINYL SULFONE TYPE REACTIVE DYES AND SULFURIC ACID ADDED AT DYEING TEMPERATURE

[75] Inventors: Hans-Ulrich von der Eltz, Frankfurt am Main; Karl-Heinz Röstermundt, Eschborn; Klaus Türschmann, Hofheim am Taunus; Joachim W. Lehmann, Kelkheim, all of Fed. Rep. of Germany

[73] Assignee: Hoechst Aktiengesellschaft, Frankfurt am Main, Fed. Rep. of Germany

[21] Appl. No.: 942,530

[22] Filed: Dec. 16, 1986

[30] Foreign Application Priority Data

Dec. 18, 1985 [DE] Fed. Rep. of Germany ..... 3544793

[51] Int. Cl.[4] ..... D06P 1/38; D06P 3/14

[52] U.S. Cl. ..... 8/549; 8/400; 8/533; 8/618; 8/917

[58] Field of Search ..... 8/549, 400, 533

[56] References Cited

U.S. PATENT DOCUMENTS 4,304,566 12/1981 von der Eltz et al. ..... 8/533
4,656,846 4/1987 Damm et al. ..... 68/207

FOREIGN PATENT DOCUMENTS 0126042 11/1984 European Pat. Off. .

*Primary Examiner*—A. Lionel Clingman
*Attorney, Agent, or Firm*—Connolly & Hutz

[57] ABSTRACT

The dyeing of wool with reactive dyes in a strongly acid medium (containing sulfuric acid) requires no longer acceptable, long heating-up times (50–60 minutes) in order to obtain level dyeings. It has now been found, according to the invention, that by rapidly heating up the dyebath which contains the dyes of the vinylsulfonyl type and also all the ingredients, except the acid, to the dyeing temperature together with the material to be dyed and then metering in the sulfuric acid under isothermal conditions at the dyeing temperature it is possible to obtain very level and very fast dyeings in a significantly shorter overall dyeing time. Carbonized wool can be dyed without prior neutralization.

9 Claims, No Drawings

ISOTHERMAL RAPID-DYEING PROCESS FOR WOOL WITH VINYL SULFONE TYPE REACTIVE DYES AND SULFURIC ACID ADDED AT DYEING TEMPERATURE

The present invention relates to a process for the level dyeing of wool or of the wool portion of fiber blends by the exhaust-dyeing technique in a strongly acid medium with aqueous liquors of reactive dyes which have in the molecule at least one grouping which, under fixing conditions, reacts with the fiber via the vinylsulfonyl form by nucleophilic addition.

The dyeing of wool with reactive dyes is suficiently well-known in the field. To obtain level and fast dyeings, in general, the textile material is treated with aqueous solutions of these dyes at temperatures of 98° to 106° C. and, depending on the desired depth of shade of the dyeing, at accurately graded pH values between 4.5 and 6.5.

Furthermore, shade card S 8126 "®Remazolan dyes on wool" from Hoechst AG describes a process whereby reactive dyes of the vinylsulfonyl type in the form of the β-sulfatoethyl sulfone derivatives are dyed onto wool articles by exhaustion from strongly acidic liquors at pH values of 2 to 3 (set with sulfuric acid). This method is characterized by a very slow heating-up of the dyebath from the initial temperature of 50° C. to the actual dyeing temperature of 98° to 100° C. and by a subsequent long dyeing time of 60 to 90 minutes at the dyeing temperature. In total, pure dyeing times of 2 to 2½ hours are required for carrying out this dyeing technique. This method is based on the assumption that level dyeings can only be obtained by means of extended heating-up periods.

The fastness properties obtainable for such reactive dyeings on wool by the conventional process in a strongly acidic medium are perfectly comparable to those produced with fulling dyes which exhaust from a weakly acidic medium, and are absolutely acceptable and customary for normal wool articles. However, this known process for coloring wool does have the disadvantage that it requires long dyeing times, and that on occasion the levelness of the dyeings produced with the reactive dyes is inadequate.

All the abovementioned prior art dyeing methods require the reactive dye and acid (fixing assistant) to be present together from the start in the exhaust bath already charged with the wool material to be dyed, the onset of the actual fixing process through interaction between reactive dye and wool fiber being controlled solely by raising the liquor temperature.

It is thus an object of the present invention to develop a rapid-dyeing process for wool with reactive dyes by the exhaust method, which, in addition to giving good levelness of the dyeings, makes it possible to obtain adequate fastness properties of the same with distinct shortening of the total treatment time for the dyed material compared with the dyeing methods of the same generic category previously introduced.

This object is achieved according to the invention by heating the exhaust liquor which contains the reactive dyes of the vinylsulfonyl type and possibly all the other ingredients, but no acid or acid-donating agents required for fixing the dyes, together with the material to be dyed to the dyeing temperature within the range from 95° to 110° C. as rapidly as possible and in one step, then, on reaching the dyeing temperature and while maintaining appropriate isothermal conditions for dye fixation, adding to the hot dyebath sulfuric acid a little at a time over a prolonged period, and dyeing the wool at pH values between 2 and 3.

"As rapidly as possible" in connection with the defining clause of this invention means as rapidly as the output of the dyeing machines used will allow. Modern machines permit heating-up times between 10 and 15 minutes. "In one step" seeks to convey that the actual dyeing operation is effected without passing through incremental temperature conditions during the fixing of dyes. "Under isothermal conditions" is to be understood as meaning that the temperature of liquor and textile material is kept constant during the treatment step of acid addition and subsequent dyeing time.

The metering of the acid over a prolonged period into the dyeing liquor which is under fixing conditions for the dye can be carried out, in terms of quantities, not only linearly but also progressively, except that the time during which the bath temperature is kept constantly high in the course of the addition of the acid counts as part of the total dyeing time and consequently the total dyeing time is not prolonged by the process according to the invention. The pure metering time can range from 10 to 45 minutes, thereby advantageously shortening the total dyeing time (including the metering time) to a maximum of 70 minutes.

If the acid fixing agent is metered in at a linear rate, a constant amount of acid is introduced into the dyebath per unit time. This can be effected on the one hand by introducing the sulfuric acid, in general diluted with water, either discontinuously in constant amounts and at constant intervals, or, however, by adding the sulfuric acid continuously in a constant amount per unit time.

Progressive metering of the acid fixing agent introduces a progressively increasing amount of acid into the dyebath per unit time as the metering time progresses, which can likewise be effected manually. In recent dispensing equipment this form of metering is automated, so that all that is necessary is to set the desired steepness of the progression in accordance with a predetermined mathematical function, for example linearly, exponentially or parabolically.

The amount of sulfuric acid to be introduced, like the dyeing time, depends on the desired depth of shade of the dyeing. If the sulfuric acid used is of 96% strength, 3 to 5% thereof are required on weight of wool fiber. Expediently, however, the concentrated acid is introduced in the claimed process diluted with water. On the one hand, this reduces the dangers of handling the acid, and on the other it makes possible a graduated, more uniform metering.

The dyeing process according to the present invention is chiefly used for ordinary wool, i.e. wool which has not been pretreated with an antifelting finish, or fiber blends of such composition. In this context, wool is to be understood as meaning wool at any stage of processing, i.e. in the form of loose fiber, slubbing, yarn, piece goods or even completed articles. It is to be noted in particular that the dyeing treatment according to the invention is also suitable for carbonized wool, which need not be especially neutralized before dyeing, unlike all other dyeing processes for wool, where this is a prerequisite for the level outcome of the dyeing. In the new process it is thus also possible to save this time, so that the total time saving is still higher.

Even wool which has been given a non- or low-felting finish can be dyed level with the dyeing technique according to this invention, but in general the obtainable wet fastness properties are not sufficient for this article, so that only in exceptional cases will the claimed process be of interest for that purpose.

To dye wool fibers or the wool portion of fiber blends by the present process, the possible reactive dyes are those organic dyes of the vinylsulfonyl type which are known by this generic name and with which the fiber reacts in an addition mechanism via the vinylsulfonyl form of the dye.

This class of dyes is referred to in the Colour Index, 3rd edition 1971 and supplements 1975, as "C.I. Reactive Dyes", and comprises chemical compounds of dye character which are capable of entering a covalent bond with OH- and/or NH-containing fibers. In this context, those dyes which contain groups which are capable of reaction with hydroxyl or amino groups in fiber material of polyamide structure contain, in addition to the vinylsulfonyl radical itself, predominantly precursors of this characteristic grouping, which include in particular the β-sulfatoethylsulfonyl group, the β-chloroethylsulfonyl group or the β-dialkylaminoethylsulfonyl group, which react with the fiber during dyeing by forming the vinylsulfonyl form intermediate.

It is also possible to use in the claimed process the conversion products of such known sulfonyl reactive dyes with, for example, methyltaurine, in which the reactive group is temporarily present in masked form.

It is true that reactive dyes having other reactive systems can likewise be dyed according to the invention, but stringent dye selection is necessary, since the risk of obtaining unlevel dyeings is not completely eliminated by the new process in the case of these dyes.

Astonishingly, however, dyes which, in addition to a reactive radical of the vinylsulfonyl type or one of the reactive groupings described above as a precursor thereof, have a grouping which reacts with wool by the substitution mechanism, for example a monochlorotriazinyl or monofluorotriazinyl group, produce very level dyeings with even better fastness properties.

Suitable basic structures of the chromophoric system of these organic dyes are in particular those from the series of the azo, anthraquinone and phthalocyanine compounds, it being possible for the azo and phthalocyanine dyes to be not only metal-free but also metal-containing.

Reactive dyes of the previously defined type frequently have more than one sulfonic acid group (in addition to that in the reactive grouping of the dye) in the molecule; these sulfonic acid groups can be distributed over the chromophore in any desired way, but are preferably bonded to the aromatic radicals thereof.

The process itself is basically carried out as follows. The manner of metering in the acid can be varied within wide limits, as is immediately clear from the metering times mentioned. In general, the acid is added in dilute form, which permits more suitably graduated metering:

The aqueous dyebath is made up with all ingredients, such as dye, assistants and possible chemicals, except the acid required, and together with the material to be dyed it is raised as rapidly as the equipment permits to the fiber-dependent dyeing temperature. Straightaway the heating-up phase produces a time saving of 10 to 40 minutes compared with the conventional processes. Immediately on reaching the dyeing temperature the metered addition of the required acid is started. The addition can be effected a little at a time in accordance with a certain schedule, as for example in Example 1 below, or continuously in accordance with a predetermined mathematical function (linearly or, for example, exponentially or parabolically) with a dispenser, for example of the type described in European Offenlegungsschrift EP-A2No.0,126,042. Equipment of this type has recently become commercially available.

During the time the acid is added and for a certain time thereafter, the bath temperature is held constant. After the proposed dyeing time has ended, the dyeing is finished in the manner customary for wool.

As regards the coloristic result obtained according to the invention, it was surprising to those skilled in the art that it is possible to obtain level dyeings having a high fastness level on wool with reactive dyes under the strongly acidic dyeing conditions within a short time, since it had been hitherto assumed that, as the pH value decreases, the fastness level of wool dyeings with reactive dyes drops off sharply. The deep penetration of, for example, felts is likewise a particular feature of the the new process. Also to be noted is the excellent levelness of the dyeings on the fiber and in the piece.

The fastness level of wool articles dyed by the process according to the invention is, after the concluded dyeing process, already on a par with the level of fast acid dyes and can be improved still further by subjecting the dyeing to an ammoniacal aftertreatment for 10 minutes at pH 8 to 8.5 and 80° C.

The examples which follow are not intended to restrict the claimed process in any way, in particular not in respect of the reactive dyes used, but merely serve to illustrate the procedure of the present invention. The percentages given in these worked examples are based on the weight of the articles to which they refer, and in the case of wool are expressed relative to the dry state of the material to be dyed. The reactive dyes mentioned are used in commercially available form and constitution. Dyes which are conversion products of sulfonyl reactive dyes with N-methyltaurine are present after the prescribed dissolving step in the structure reproduced by the respective formula.

EXAMPLE 1

To dye 80 kg of a wool knit which has not been pretreated with an antifelting finish, by the exhaust method using a liquor ratio of 10:1, an aqueous bath of 40° C. is prepared in a dyeing machine with the following ingredients:

3% of the reactive dye of the formula

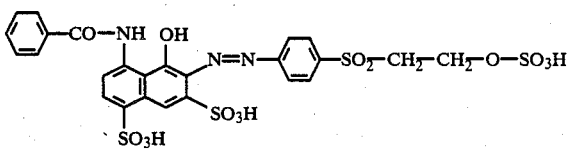

1% of a reactive dye obtained by converting the corresponding dye of the vinylsulfonyl type with N-methyltaurine and having the formula

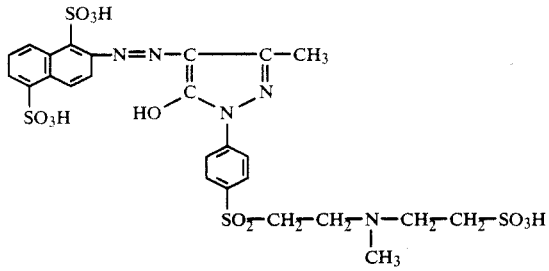

1.5% of an assistant mixture of the reaction product of 1 mole of stearylamine with 12 moles of ethylene oxide, to which triisobutyl phosphate has been added as an antifoam, and 10% of sodium sulfate.

The bath, which has been entered with the material to be dyed, is then set in circulation and is raised in the course of 10 minutes to the dyeing temperature of 100° C. Immediately this temperature is reached the addition of a total of 4% of 96% strength sulfuric acid, which corresponds to a liquid volume of 3.2 liters, is started. This addition is to be effected at constant intervals a little at a time, but in progressively larger amounts. To this end, the acid is diluted to a volume of 15 liters by pouring into cold water, and after every 7 minutes the following quantities of this solution are added in accordance with the following schedule:

| at the start | after 7 | after 14 | after 21 | after 28 minutes |
|---|---|---|---|---|
| 1 l | 2 l | 3 l | 4 l | 5 l of solution |

During this measure the temperature of the bath is held at a constant 100° C. The acid introduced has therefore been preheated beforehand to approximately dyeing temperature.

After all the acid has been added, which has led to a bath pH of 2.3, the textile material is dyed at the same temperature for a further 30 minutes. The exhausted liquor together with the dyed wool are then cooled down, and the wool is rinsed with water and finished in conventional manner.

The result obtained on the knit is a brilliant red dyeing which has good general fastness properties. Contrary to expectation, the levelness of the dyeing is very good and the penetration excellent.

EXAMPLE 2

60 kg of a fabric of carbonized wool which, however, has not subsequently been neutralized are exhaust-dyed in a beam dyeing apparatus with a liquor ratio of 15:1 as follows:

To this end the material to be dyed is introduced into an aqueous liquor at 40° C. which contains as constituents 3% of the dye Reactive Blue 19 having the C.I. No. 61200, 1% of the reactive dye of the formula

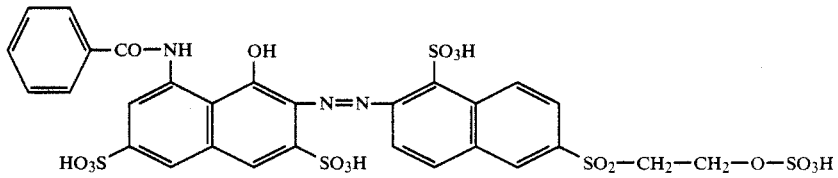

1.5% of the assistant mixture of Example 1 and

10% of sodium sulfate, whereupon this dyebath is set in circulation and raised to the dyeing temperature of 100° C. in the course of 10 minutes. The liquor which is under fixing conditions then has continuously added to it with an ADC 100 dispenser from ADCON AB, Boras/Sweden 2.4 liters of 96% strength sulfuric acid, diluted with water to a volume of 20 liters, in the course of 45 minutes in amounts per unit time which progressively increase by 50%.

After a further 20 minutes of dyeing at 100° C., the dyeing has ended. The liquor and the textile material are then cooled down, and the dyed wool is rinsed with water and finished in conventional manner.

The result obtained on the wool fabric is a very good level blue dyeing having good fastness properties.

EXAMPLE 3

120 kg of a wool yarn which has not been given a nonfelting finish and is in cheese form are to be exhaust-dyed a fast black with a liquor ratio of 15:1.

To this end, an aqueous dyebath at 60° C. is charged with

5% of the dye Reactive Black 5 having the C.I. No. 20505

0.5% of the reactive dye of the formula

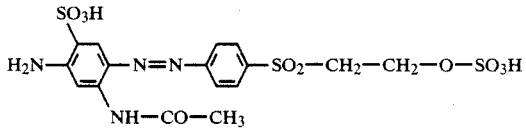

0.5% of the reactive dye of the formula

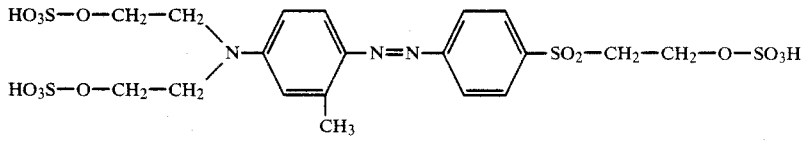

1% of the assistant mixture of Example 1, and

10% of sodium sulfate and raised together with the entered textile material to the dyeing temperature of 106° C. in the course of 15 minutes. Then the acid is manually added a little at a time in linear amounts at constant intervals to the liquor, which is under fixing conditions. To this end 5.2 liters of 96% strength sulfuric acid are diluted with water to a volume of 10 liters, and every 3 minutes, 1 liter of the solution, which is expediently preheated, is added to the bath. After the last aliquot of acid has been added, the textile material is dyed at the stated temperature for a further 20 minutes and then the bath plus the dyed material is cooled down, and the dyed wool is rinsed with water and finished in conventional manner.

This gives the desired fast and level black dyeing on the yarn. The penetration of the cheeses is excellent.

EXAMPLE 4

200 kg of ordinary wool slubbing in pack form are to be exhaust-dyed with a liquor ratio of 8:1.

To this end, an aqueous liquor at 50° C. is charged with 0.5% of a reactive dye obtained by converting the corresponding dye of the vinylsulfonyl type with N-methyl-taurine and having the formula

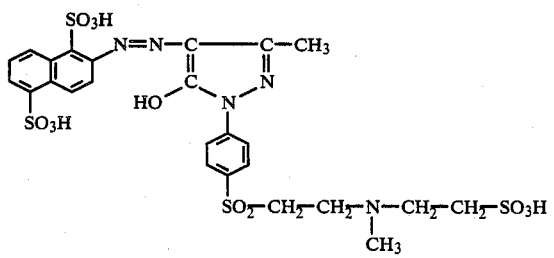

0.5% of a reactive dye obtained by converting the corresponding dye of the vinylsulfonyl type with N-methyltaurine and having the formula

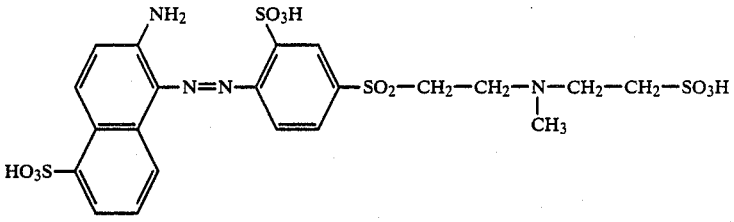

0.5% of a reactive dye obtained by converting the corresponding dye of the vinylsulfonyl type with N-methyltaurine and having the formula

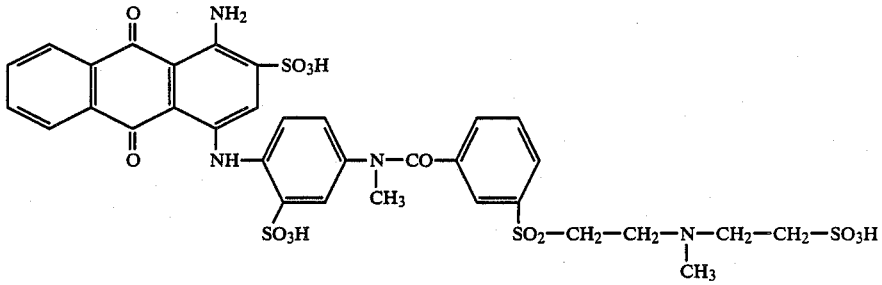

1.5% of the assistant mixture of Example 1, and

10% of sodium sulfate, the bath is raised to the dyeing temperature of 106° C. in the course of 15 minutes, and the continuous, program-controlled addition of acid is started immediately, with the proviso that this liquor has added to it, under the stated temperature conditions, 3 liters of 96% strength sulfuric acid, diluted with water to a volume of 30 liters, in the course of 45 minutes in amounts per unit time which progressively increase by 60%.

After the acid has been added, the textile material is dyed at 106° C. for a further 10 minutes, and is then cooled down together with the liquor, rinsed with water and finished in conventional manner for wool.

The result obtained is a very good level brown slubbing.

EXAMPLE 5

60 kg of a carbonized, but subsequently not neutralized, wool crepe fabric are to be exhaust-dyed with a liquor ratio of 20:1.

To this end,

4% of the reactive dye of the formula

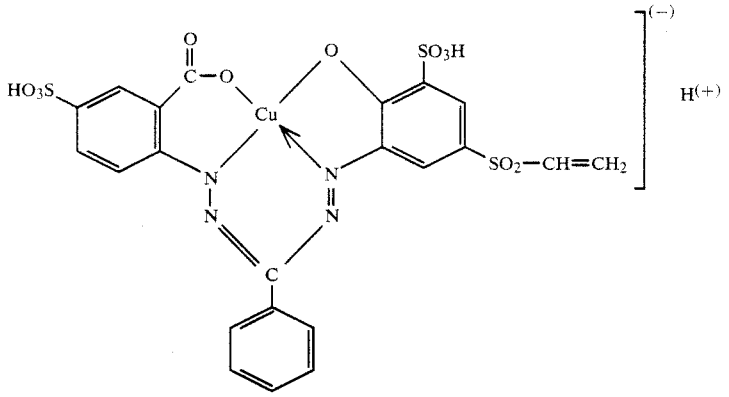

0.5% of a reactive dye obtained by converting the corresponding dye of the vinylsulfonyl type with N-methyltaurine and having the formula

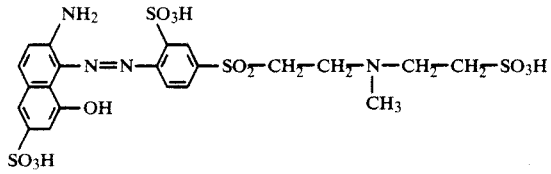

0.25% of the reactive dye of the formula

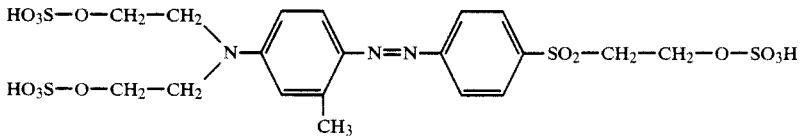

1.5% of the assistant mixture of Example 1 and
10% of sodium sulfate
are brought into solution in an aqueous bath at 50° C. The temperature of this liquor is then raised to 98° C. (boiling point at the given altitude) in the course of 10 minutes, and using an ADC 100 dispenser from ADCON AB, Boras/Sweden 3 liters of 96% strength sulfuric acid, diluted with water to a volume of 30 liters, are then continuously added at constant temperature to the dyebath in the course of 30 minutes in amounts per unit time which progressively increase by 60%.

After a further 30 minutes of dyeing at 98° C., the liquor is cooled down by running in cold water, and the dyed material is rinsed until clear and can then be removed from the dyeing kier.

The result obtained on the fabric is a dark blue (navy) dyeing of excellent levelness and very attractive appearance.

EXAMPLE 6

A jet dyeing machine is to be used to dye 70 kg of a normal wool crepe fabric with a liquor ratio of 8:1 by the exhaust method.

To this end, an aqueous bath is prepared by dissolving in water at 50° C.

1.5% of the reactive dye of the formula

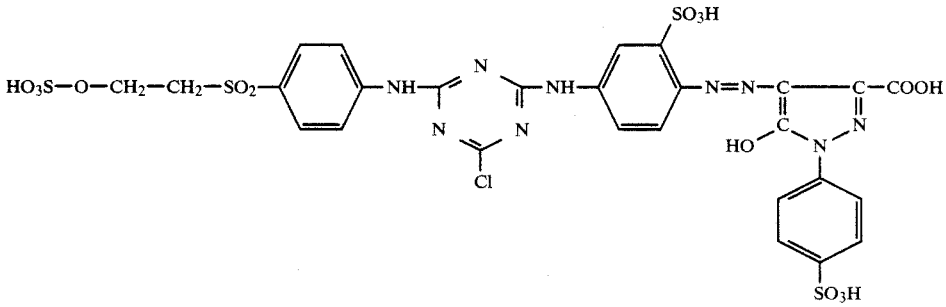

10% of sodium sulfate and
1.5% of the assistant mixture of Example 1 and raising the temperature to 106° C. in the course of 10 minutes. Immediately on reaching this dyeing temperature the metered addition of 2.8 liters of 96% strength sulfuric acid, previously poured into 15 liters of cold water, is started by continuously adding the dilute acid to the dye liquor in the course of 20 minutes by means of a dispensing device in amounts per unit time which increase in 50% progression.

The fabric is then dyed at 106° C. for a further 30 minutes, and the liquor and the textile material are then cooled down and the dyed fabric is rinsed with water and finally finished in conventional manner.

The result obtained on the wool is a brilliant orange dyeing having a high fastness level.

EXAMPLE 7

If in carrying out the dyeing operation in accordance with the method of Example 6 the dye used there is replaced here by 2% of the reactive dye of the formula

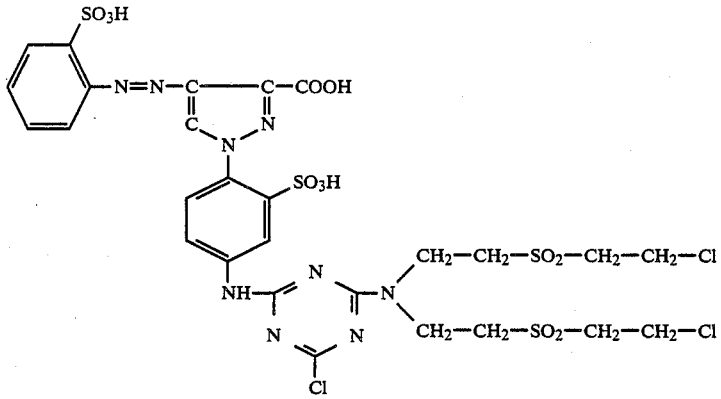

and the procedure used is otherwise as in Example 6, then the result obtained on the wool is a brilliant yellow dyeing having very good fastness properties which, without aftertreatment, are up to the standard of a reactive dyeing produced under conventional conditions.

We claim:

1. A process for the level dyeing of wool or of the wool portion of fiber blends by the exhaust dyeing technique in a strongly acidic medium with aqueous liquors of reactive dyes which have in their molecule at least one grouping which, under fixing conditions, reacts with the fiber via the vinylsulfonyl form by nucleophilic addition, which comprises heating the exhaust liquor which contains such dyes of the vinylsulfonyl type, but no acid or acid-donating agents required for fixing the dyes, together with the material to be dyed to the dyeing temperature within the range from 95° C. to 106° C. as rapidly as possible and in one step, then, on reaching the dyeing temperature and while maintaining appropriate isothermal conditions for dye fixation, adding sulfuric acid to the hot dyebath incrementally within a period of 10 to 45 minutes, and dyeing the wool at pH values between 2 and 3.

2. The process as claimed in claim 1, wherein the addition of all the acid is effected discontinuously in equal portions at constant intervals.

3. The process as claimed in claim 1, wherein the addition of all the acid is effected continuously in the same amount per unit time.

4. The process as claimed in claim 1, wherein the addition of all the acid is effected discontinuously in increasing amounts at constant intervals.

5. The process as claimed in claim 1, wherein the addition of all the acid is effected continuously in an increasing amount in accordance with a schedule corresponding to a mathematical function.

6. The process as claimed in claim 1, wherein the treatment time of the wool at the dyeing temperature amounts to a total between 60 and 70 minutes.

7. The process as claimed in claim 1, wherein the wool is dyed with reactive dyes which, in addition to a reactive group of the vinylsulfonyl type, contain at least one monochlorotriazinyl or monofluorotriazinyl group.

8. The process as claimed in claim 1, wherein wool which has not been pretreated with an antifelting finish is dyed.

9. The process as claimed in claim 8, wherein carbonized wool which has not been subjected to prior neutralization is dyed.

* * * * *